US010287860B2

(12) United States Patent
Babin et al.

(10) Patent No.: US 10,287,860 B2
(45) Date of Patent: May 14, 2019

(54) DOWNHOLE MECHANICAL TUBING PERFORATOR

(71) Applicant: Halliburton Energy Services, Inc., Houston, TX (US)

(72) Inventors: Jacques Babin, Kingwood, TX (US); Jack Clemens, Fairview, TX (US); Matthew Mlcak, Carrollton, TX (US); Firas Al Ktoot, Amman (JO)

(73) Assignee: Halliburton Energy Services, Inc., Houston, TX (US)

( * ) Notice: Subject to any disclaimer, the term of this patent is extended or adjusted under 35 U.S.C. 154(b) by 217 days.

(21) Appl. No.: 15/029,560

(22) PCT Filed: Nov. 14, 2013

(86) PCT No.: PCT/US2013/070152
§ 371 (c)(1),
(2) Date: Apr. 14, 2016

(87) PCT Pub. No.: WO2015/073011
PCT Pub. Date: May 21, 2015

(65) Prior Publication Data

US 2016/0258257 A1 Sep. 8, 2016

(51) Int. Cl.
*E21B 43/112* (2006.01)
*E21B 29/00* (2006.01)

(52) U.S. Cl.
CPC ..... *E21B 43/112* (2013.01); *E21B 29/005* (2013.01)

(58) Field of Classification Search
CPC ..... E21B 43/112
See application file for complete search history.

(56) References Cited

U.S. PATENT DOCUMENTS

| | | | | |
|---|---|---|---|---|
| RE21,824 | E * | 6/1941 | Lowrey | E21B 29/005 166/298 |
| 7,467,661 | B2 | 12/2008 | Gordon et al. | |
| 2005/0133224 | A1 | 6/2005 | Ruttley | |
| 2007/0151731 | A1 | 7/2007 | Butler et al. | |
| 2007/0277980 | A1 | 12/2007 | Gordon et al. | |
| 2010/0258289 | A1* | 10/2010 | Lynde | E21B 23/14 166/55.7 |
| 2010/0288491 | A1 | 11/2010 | Cochran et al. | |
| 2012/0186817 | A1* | 7/2012 | Gibson | E21B 23/006 166/298 |
| 2013/0319651 | A1* | 12/2013 | Pasvandi | E21B 43/112 166/55.2 |

(Continued)

OTHER PUBLICATIONS

International Search Report of PCT Application No. PCT/US2013/070152 dated Aug. 14, 2014: pp. 1-4.

(Continued)

*Primary Examiner* — Robert E Fuller
(74) *Attorney, Agent, or Firm* — Chamberlain Hrdlicka

(57) ABSTRACT

Methods and apparatus include mechanically perforating a tubular positioned in a subterranean wellbore. A plurality of mechanical penetrators are moved radially outward, simultaneously or sequentially, in response to an actuating force applied from a downhole power unit or tubing pressure. After perforating the downhole tubular, the penetrators are retracted for re-use at a new location or for retrieval. A slip assembly can secure the tool in position during use.

19 Claims, 8 Drawing Sheets

(56) References Cited

U.S. PATENT DOCUMENTS

| | | | | |
|---|---|---|---|---|
| 2014/0027117 | A1* | 1/2014 | Hekelaar | E21B 43/112 166/297 |
| 2014/0083674 | A1* | 3/2014 | Pasvandi | E21B 43/112 166/55.2 |
| 2014/0374100 | A1* | 12/2014 | Hallundbaek | E21B 43/112 166/298 |
| 2016/0215596 | A1 | 7/2016 | Cook et al. | |

OTHER PUBLICATIONS

Anonymous, Datasheet H010507: "DPU-Acatuated Tubing Perforator," Halliburton, Aug. 2013: pp. 1-2.

* cited by examiner

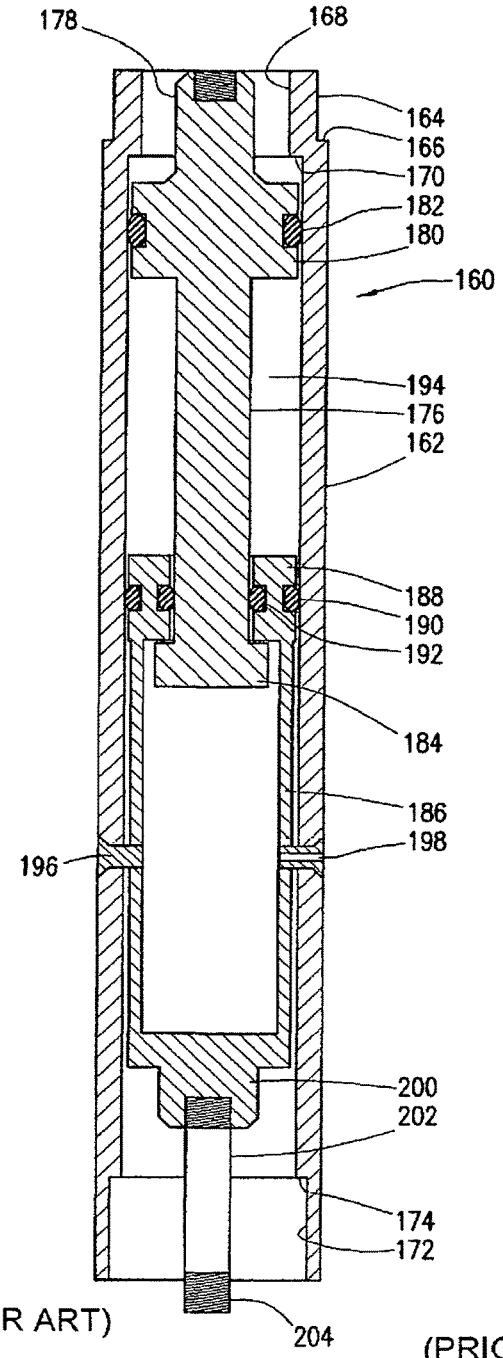
(PRIOR ART)
FIG. 4
FIG. 5
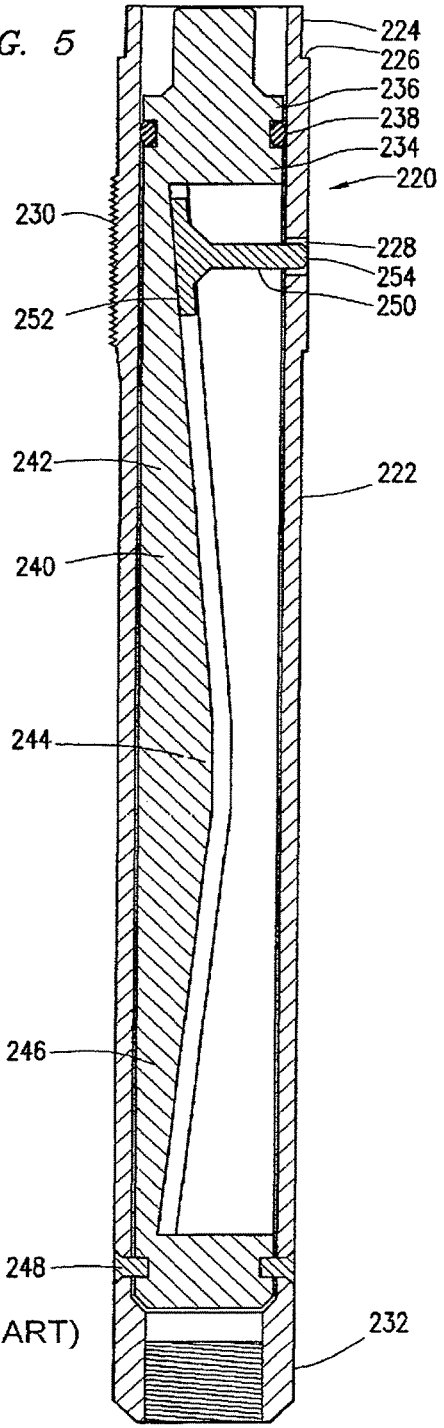
(PRIOR ART)

(PRIOR ART)

DOWNHOLE MECHANICAL TUBING PERFORATOR

CROSS-REFERENCE TO RELATED APPLICATIONS

None.

TECHNICAL FIELD

The disclosure relates, in general, to establishing communication between the interior of a downhole tubular and the surrounding annulus and, more particularly, to a downhole mechanical perforator assembly for perforating a downhole tubular using a downhole power unit.

BACKGROUND

During the lifetime of an oil or gas well, it is typical at some point to provide selective establishment of fluid communication between the interior of a tubular string, such as a casing, liner, tubing, or the like, and the annulus surrounding the tubular string. Communication is established by creating one or more perforations tubular. It is common to use high-explosive, shaped charges to create the perforations. The shaped charges are detonated at a selected location downhole, often creating a jet of high energy plasma which penetrates the tubular string, thereby forming an opening. As hydrocarbon production increases throughout the world, certain jurisdictions discourage or prohibit the use of such explosives. Consequently, mechanical perforators have been used to perforate downhole tubulars to establish communication between the tubular interior and the surrounding annulus.

BRIEF DESCRIPTION OF THE DRAWINGS

For a more complete understanding of the features and advantages of the present disclosure, reference is now made to the detailed description of the disclosure along with the accompanying figures in which corresponding numerals in the different figures refer to corresponding parts and in which:

FIG. 4 is a cross sectional view of one embodiment of an actuator of a downhole perforator assembly according to the present disclosure;

FIG. 5 is a cross sectional view of one embodiment of a downhole perforator of a downhole perforator assembly according to the present disclosure;

Figure 1C:
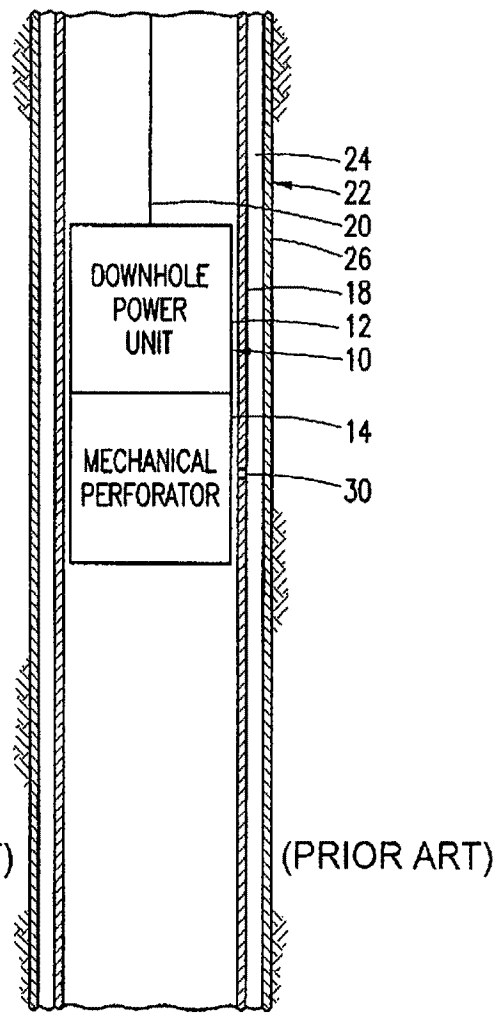
(PRIOR ART) FIG. 1C
FIGS. 1A-1C are block diagrams illustrating the operation of a downhole perforator assembly according to the present disclosure.

It is understood by those skilled in the art that the use of directional terms such as above, below, upper, lower, upward, downward and the like are used in relation to the illustrative embodiments as they are depicted in the figures. Where this is not the case and a term is being used to indicate a required orientation, the specification will make such clear. Upstream, uphole, downstream and downhole are used to indicate location or direction in relation to the surface, where upstream indicates relative position or movement towards the surface along the wellbore and downstream indicates relative position or movement further away from the surface along the wellbore, unless otherwise indicated.

DETAILED DESCRIPTION

The present disclosures are described by reference to drawings showing one or more examples of how the disclosures can be made and used. In these drawings, reference characters are used throughout the several views to indicate like or corresponding parts. In the description which follows, like or corresponding parts are marked throughout the specification and drawings with the same reference numerals, respectively. The drawings are not necessarily to scale and the proportions of certain parts have been exaggerated to better illustrate details and features of the disclosure. In the following description, the terms "upper", "upward", "lower", "below", "downhole", "longitudinally", "axially" and the like, as used herein, shall mean in relation to the bottom, or furthest extent of, the surrounding wellbore even though the wellbore or portions of it may be deviated or horizontal. Correspondingly, the "transverse" or "radial" orientation shall mean the orientation perpendicular to the longitudinal or axial orientation. In the discussion which follows, generally cylindrical well, pipe and tube components are assumed unless expressed otherwise.

Even though the methods herein are discussed in relation to a well having a particular orientation, it should be understood by those skilled in the art that the system disclosed herein is suited for use in wells having other configurations including vertical wells, deviated wells, inclined wells, horizontal wells, multilateral wells and the like. Accordingly, use of directional terms such as "above", "below", "upper", "lower" and the like are used for convenience. Also, even though the discussion refers to a surface well operation, it should be understood by those skilled in the art that the apparatus and methods can also be employed in an offshore operation.

Figure 1B:
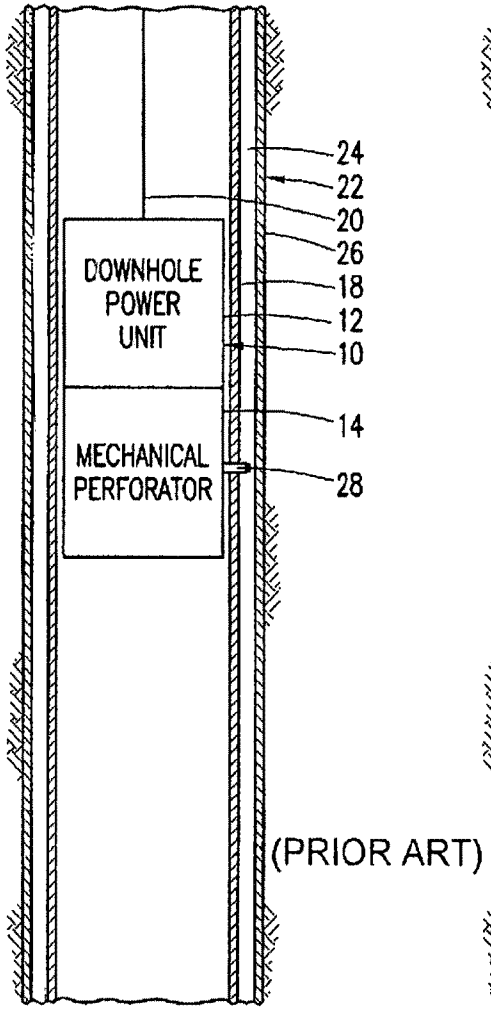
(PRIOR ART) FIG. 1B
Figure 1A:
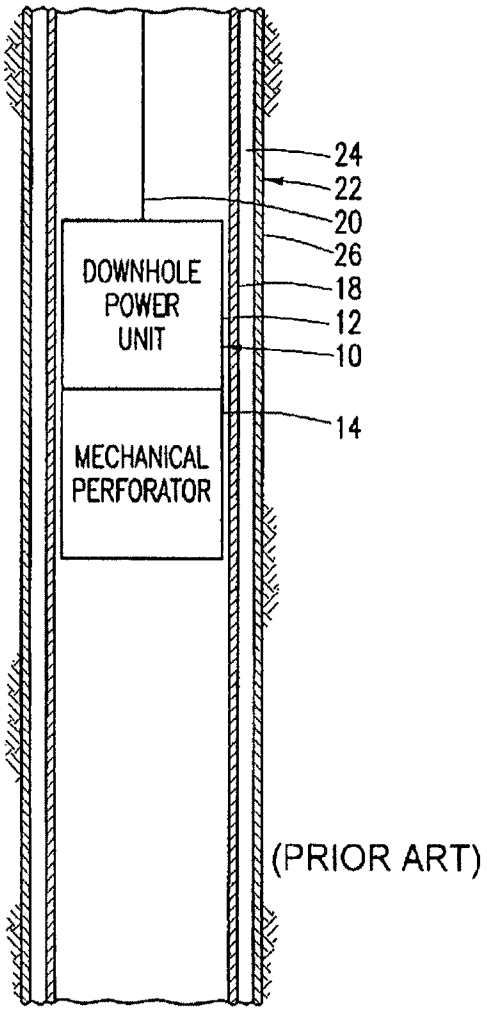
(PRIOR ART) FIG. 1A

Referring initially to FIGS. 1A-1C, therein is schematically depicted a downhole perforator assembly of the present disclosure in its various operational states generally designated 10. Downhole perforator assembly 10 includes a downhole power unit 12 and a downhole mechanical perforator 14, each of which will be discussed in greater detail below. Downhole perforator assembly 10 has a movable member described herein as a movable shaft operably associated with and couples to downhole perforator 14. Downhole perforator assembly 10 is illustrated as having been lowered into a tubular string 18 such as a casing string, a liner string, a tubing string or the like on a conveyance 20 such as a wireline, a slickline, coiled tubing, jointed tubing, downhole robot or the like.

In the illustrated embodiment, tubular string 18 has been previously installed within well 22 such that an annulus 24 is formed between casing 26 and tubular string 18. In order to allow circulation between the interior and annulus a communication path must be established.

As depicted in FIG. 1A, downhole perforator assembly 10 has reached its target location in well 22. The downhole perforator 14 is operated from its running configuration to its perforating configuration using downhole power unit 12. Specifically, downhole power unit 12 transmits a longitudinal force to a mandrel within downhole perforator 14 via a movable shaft of downhole power unit 12 such that a penetrator 28 is radially outwardly projected from downhole perforator 14. As best seen in FIG. 1B, penetrator 28 extends radially outwardly from downhole perforator 14 and through the sidewall of tubular string 18. Further longitudinal movement of the mandrel of downhole perforator 14 causes penetrator 28 to retract within downhole perforator 14. As best seen in FIG. 1C, once penetrator 28 has been retracted, a fluid passageway 30 is formed through tubular string 18, thereby allowing the circulation of fluids between the interior of tubular string 18 and annulus 24. After fluid passageway 30 has been formed, downhole perforator assembly 10 can be retrieved to the surface.

A particular implementation of downhole power unit 12 includes an elongated housing, a motor disposed in the housing and a sleeve connected to a rotor of the motor. The sleeve is a rotational member that rotates with the rotor. A movable member such as the movable shaft is received within the threaded interior of the sleeve. Operation of the motor rotates the sleeve which causes the movable shaft to move longitudinally. Accordingly, when downhole power unit 12 is operably coupled with downhole perforator 14 and the movable member is activated, longitudinal movement is imparted to the mandrel of downhole perforator 14.

Preferably, a microcontroller made of suitable electrical components to provide miniaturization and durability within the high pressure, high temperature environments which can be encountered in an oil or gas well is used to control the operation of downhole power unit 12. The microcontroller is preferably housed within the structure of downhole power unit 12, it can, however, be connected outside of downhole power unit 12 but within an associated tool string moved into well 22. In whatever physical location the microcontroller is disposed, it is operationally connected to downhole power unit 12 to control movement of the movable member when desired. In one embodiment, the microcontroller includes a microprocessor which operates under control of a timing device and a program stored in a memory. The program in the memory includes instructions which cause the microprocessor to control the downhole power unit 12.

The microcontroller operates under power from a power supply which can be at the surface of well 22 or, preferably, contained within the microcontroller, downhole power unit 12 or otherwise within a downhole portion of the tool string of which these components are a part. For a particular implementation, the power source provides the electrical power to both the motor of downhole power unit 12 and the microcontroller. When downhole power unit 12 is at the target location, the microcontroller commences operation of downhole power unit 12 as programmed. For example, with regard to controlling the motor that operates the sleeve receiving the movable member, the microcontroller sends a command to energize the motor to rotate the sleeve in the desired direction to either extend or retract the movable member at the desired speed. One or more sensors monitor the operation of downhole power unit 12 and provide responsive signals to the microcontroller. When the microcontroller determines that a desired result has been obtained, it stops operation of downhole power unit 12, such as by de-energizing the motor.

Figure 2C:
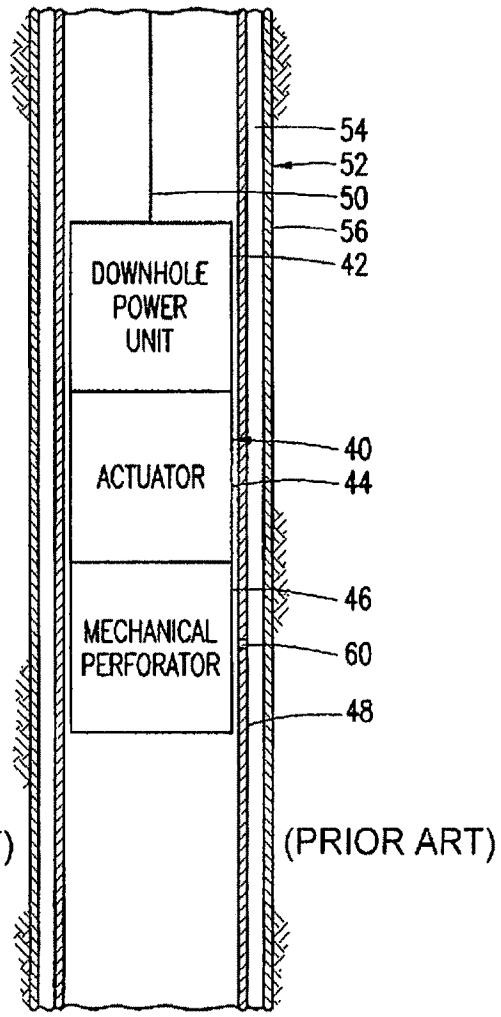
FIGS. 2A-2C are block diagrams illustrating the operation of another downhole perforator assembly according to the present disclosure.
Figure 2B:
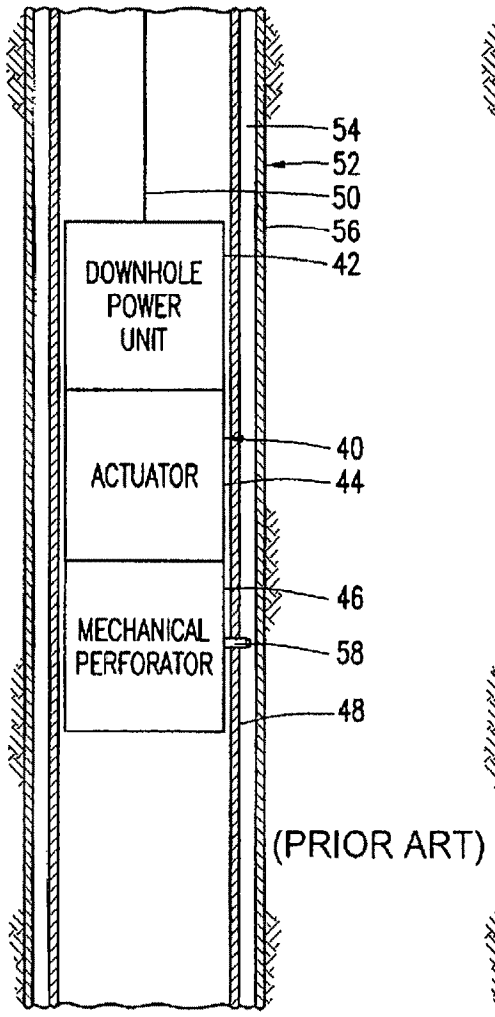
Figure 2A:
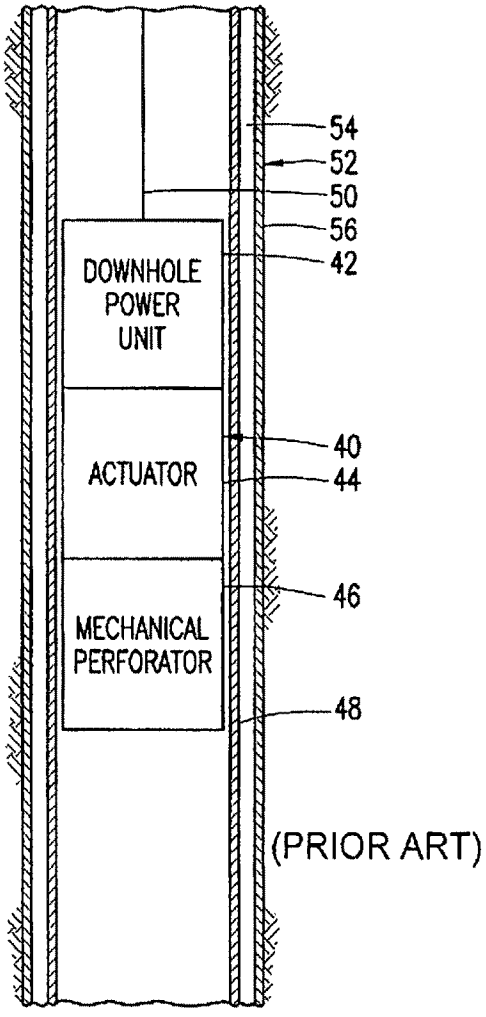

Referring next to FIGS. 2A-2C, therein is schematically depicted a downhole perforator assembly of the present disclosure in its various operational states generally designated 40. Downhole perforator assembly 40 includes a downhole power unit 42, an actuator 44 and a downhole mechanical perforator 46. Downhole power unit 42 has a movable shaft operably associated with and coupled to actuator 44. Actuator 44 has a piston operably associated with and coupled to downhole perforator 46. Downhole perforator assembly 40 is illustrated in tubular string 48 on a conveyance 50, such as a wireline, a slickline, coiled tubing, jointed pipe or other tubing string. Tubular string 48 is shown installed within well 52 such that an annulus 54 is formed between casing 56 and tubular string 48. A communication path is to be established between the interior of tubular string 48 and annulus 54.

As depicted in FIG. 2A, downhole perforator assembly 40 has reached its target location in well 52. As explained in greater detail below, downhole perforator 46 is operated from its running configuration to its perforating configuration using downhole power unit 42 and actuator 44. Specifically, downhole power unit 42 transmits a longitudinal force via a movable shaft to a mandrel within actuator 44 that triggers the operation of a piston within actuator 44. The piston transmits a longitudinal force to a mandrel of downhole perforator 46 such that a penetrator 58 is radially outwardly projected from downhole perforator 46. As best seen in FIG. 1B, penetrator 58 extends radially outwardly from downhole perforator 46 and through the sidewall of tubular string 48. Further longitudinal movement of the mandrel of downhole perforator 46 causes penetrator 58 to retract to a position within downhole perforator 46. As best seen in FIG. 1C, once penetrator 58 has been retracted, a fluid passageway 60 is formed through tubular string 48, thereby allowing the circulation of fluids between the interior of tubular string 48 and annulus 54. After fluid passageway 60 has been formed, downhole perforator assembly 40 can be retrieved to the surface.

Figure 3A:
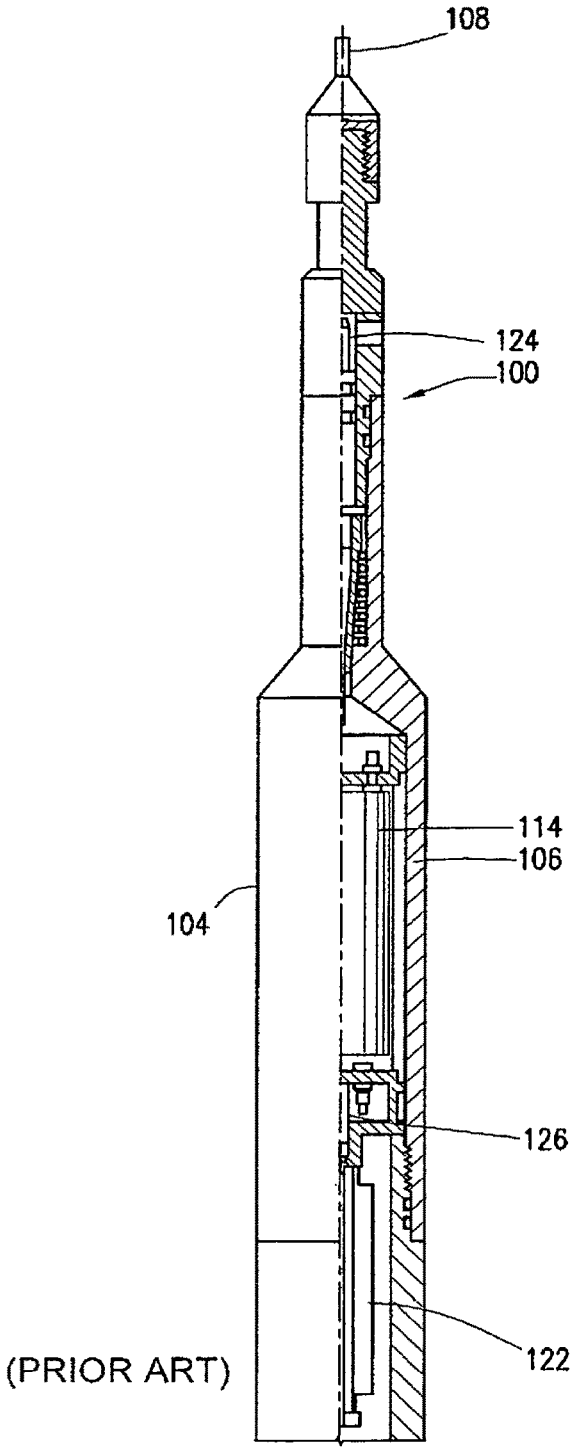
FIGS. 3A-3B are quarter sectional views of successive axial sections of one embodiment of a downhole power unit of a downhole perforator assembly according to the present disclosure.
Figure 3B:
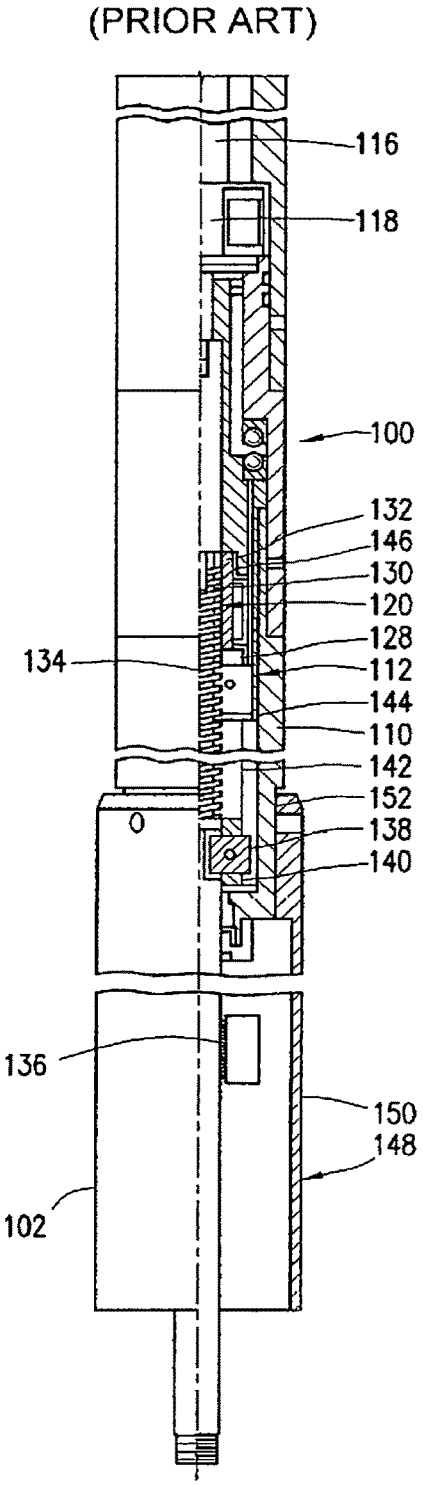

Referring now to FIGS. 3A-3B, therein are depicted successive axial sections of an exemplary downhole power unit generally designated 100. Downhole power unit 100 includes a working assembly 102 and power assembly 104. Power assembly 104 includes a housing assembly 106 which comprises suitably shaped and connected generally tubular housing members. An upper portion of housing assembly 106 includes an appropriate mechanism to facilitate coupling of housing 106 to a conveyance 108 such as a wireline, slickline, electric line, coiled tubing, jointed tubing or the like. Housing assembly 106 also includes a clutch housing 110 as will be described in more detail below, which forms a portion of a clutch assembly 112.

In the illustrated embodiment, power assembly 104 includes a self-contained power source, eliminating the need for power to be supplied from an exterior source, such as a source at the surface. A preferred power source comprises a battery assembly 114 which may include a plurality of batteries such as alkaline batteries, lithium batteries or the like.

Connected with power assembly 104 is the force generating and transmitting assembly. The force generating and transmitting assembly of this implementation includes a direct current (DC) electric motor 116, coupled through a gearbox 118, to a jackscrew assembly 120. A plurality of activation mechanisms 122, 124 and 126, as will be described, can be electrically coupled between battery assembly 114 and electric motor 116. Electric motor 116 may be of any suitable type. One example is a motor operating at 7500 revolutions per minute (rpm) in unloaded condition, and operating at approximately 5000 rpm in a loaded condition, and having a horsepower rating of approximately 1/30th of a horsepower. In this implementation, motor 116 is coupled through the gearbox 118 which provides approximately 5000:1 gear reduction. Gearbox 118 is coupled through a conventional drive assembly 128 to jackscrew assembly 120.

The jackscrew assembly 120 includes a threaded shaft 130 which moves longitudinally, rotates, or both, in response to rotation of a sleeve assembly 132. Threaded shaft 130 includes a threaded portion 134, and a generally smooth, polished lower extension 136. Threaded shaft 130 further includes a pair of generally diametrically opposed keys 138 that cooperate with a clutch block 140 which is coupled to threaded shaft 130. Clutch housing 110 includes a pair of diametrically opposed keyways 142 which extend along at least a portion of the possible length of travel. Keys 138 extend radially outwardly from threaded shaft 130 through clutch block 140 to engage each of keyways 142 in clutch housing 110, thereby selectively preventing rotation of threaded shaft 130 relative to housing 110.

Rotation of sleeve assembly 132 in one direction causes threaded shaft 130 and clutch block 140 to move longitudinally upwardly relative to housing assembly 110 if shaft 130 is not at its uppermost limit. Rotation of the sleeve assembly 132 in the opposite direction moves shaft 130 downwardly relative to housing 110 if shaft 130 is not at its lowermost position. Above a certain level within clutch housing 110, as indicated generally at 144, clutch housing 110 includes a relatively enlarged internal diameter bore 146 such that moving clutch block 140 above level 144 removes the outwardly extending key 138 from being restricted from rotational movement. Accordingly, continuing rotation of sleeve assembly 132 causes longitudinal movement of threaded shaft 130 until clutch block 140 rises above level 144, at which point rotation of sleeve assembly 132 will result in free rotation of threaded shaft 130. By virtue of this, clutch assembly 112 serves as a safety device to prevent burn-out of the electric motor, and also serves as a stroke limiter. In a similar manner, clutch assembly 112 may allow threaded shaft 130 to rotation freely during certain points in the longitudinal travel of threaded shaft 130.

In the illustrated embodiment, downhole power unit 100 incorporates three discrete activation assemblies, separate from or part of the microcontroller discussed above. The activation assemblies enable jackscrew 120 to operate upon the occurrence of one or more predetermined conditions. One depicted activation assembly is timing circuitry 122 of a type known in the art. Timing circuitry 122 is adapted to provide a signal to the microcontroller after passage of a predetermined amount of time. Further, downhole power unit 100 can include an activation assembly including a pressure-sensitive switch 124 of a type generally known in the art which will provide a control signal, for example, once the switch 124 reaches a depth at which it encounters a predetermined amount of hydrostatic pressure within the tubing string or experiences a particular pressure variation or series of pressure variations. Still further, downhole power unit 100 can include a motion sensor 126, such as an accelerometer or a geophone, sensitive to vertical motion of downhole power unit 100. Accelerometer 126 can be combined with timing circuitry 122 such that when motion is detected by accelerometer 126, timing circuitry 122 is reset. If so configured, the activation assembly operates to provide a control signal after accelerometer 126 detects that downhole power unit 100 has remained substantially motionless within the well for a predetermined amount of time.

Working assembly 102 includes an actuation assembly 148 which is coupled through housing assembly 106 to be movable therewith. Actuation assembly 148 includes an outer sleeve member 150 which is threadably coupled at 152 to housing assembly 106. Threaded shaft 130 extends through actuation assembly 148 and has a threaded end 154 for coupling to other tools such as an actuator or a downhole perforator as will be described below.

In operation, downhole power unit 100 is adapted to cooperate directly or indirectly with one or more downhole perforator tools via one or more actuators or other tools. Specifically, prior to run-in, outer sleeve member 150 of downhole power unit 100 is operably associated with a mating tubular of a downhole perforator, linear actuator, or other tool. Likewise, shaft 130 of downhole power unit 100 is operably associated with a mating mandrel of a downhole perforator, actuator, or other tool. As used herein, the term operably associated with shall encompass direct coupling such as via a threaded connection, a pinned connection, a frictional connection, a closely received relationship and may also including the use of set screws or other securing means. In addition, the term operably associated with shall encompass indirect coupling such as via a connection sub, an adaptor or other coupling means. As such, an upward longitudinal movement of threaded shaft 130 of downhole power unit 100 exerts an upward longitudinal force upon the mandrel to which it is operably associated that initiates the operation of either the downhole perforator or the actuator associated therewith as described below.

As will be appreciated from the above discussion, actuation of motor 116 by activation assemblies 122, 124, 126, and control of motor 116 by the microcontroller results in longitudinal movement of threaded shaft 130. In an implementation wherein the downhole perforator assembly includes an actuator, threaded shaft 130 is required to move a short distance to exert sufficient force to break certain shear pins or the like before a pressure differential created within the actuator is used to operate the downhole perforator. In an implementation wherein the downhole perforator assembly does not include an actuator, threaded shaft 130 is required to move a distance to exert sufficient force to break shear pins or the like and then continue upward movement for a longer stroke to directly operate the downhole perforator. In preferred embodiments, the stroke length must be sufficient to both extend and retract penetrators of the downhole perforator. Downhole power unit 100 may be preprogrammed to perform the proper operations prior to deployment into the well. Alternatively, downhole power unit 100 may receive power, command signals, or both, from the surface via cable. Once the perforating operation is complete, the downhole perforator assembly of the present disclosure can be retrieved to the surface.

Even though a particular embodiment of a downhole power unit has been depicted and described, it should be clearly understood by those skilled in the art that other types of downhole power devices could alternatively be used with the downhole perforator assembly of the present disclosure such that the downhole perforator assembly of the present disclosure may establish communication between the interior of a downhole tubular and the surrounding annulus.

Referring now to FIG. 4, therein is depicted an exemplary actuator generally designated 160. Actuator 160 includes an outer housing 162. At its upper end, outer housing 162 has a radially reduced exterior portion 164 and an exterior shoulder 166 that allow for coupling with outer sleeve member 150 of downhole power unit 100 or other tool. This coupling may be achieved using a threaded connection, a pin connection or other suitable means. Outer housing 162 also has a radially reduced interior portion 168 and an internal shoulder 170. In addition, outer housing 162 has a radially expanded interior portion 172 and an interior shoulder 174 at its lower end.

Slidably and sealingly disposed within outer housing 162 is a mandrel 176. Mandrel 176 includes an upper connector 178 to couple to shaft 130 of downhole power unit 100 or other tool. Mandrel 176 has a radially expanded section 180 including a seal groove having a seal 182 located therein, which provides the sealing relationship with the interior of outer housing 162. Mandrel 176 also has a radially expanded lower section 184.

Actuator 160 further includes a piston 186 slidably and sealingly disposed within outer housing 162. Piston 186 has a radially reduced upper portion 188 positioned above radially expanded lower section 184 of mandrel 176. Radially reduced upper portion 188 includes an exterior seal groove having a seal 190 located therein, which provides a sealing relationship with the interior of outer housing 162. Radially reduced upper portion 188 also includes an interior seal groove having a seal 192 located therein, which provides a sealing relationship with the exterior of mandrel 176. When assembled, an atmospheric chamber 194 is created within actuator 160 between seals 182, 190, 192.

Piston 186 is initially fixed relative to outer housing 162 by a plurality of shear pins 196 at least one of which may include a fluid passageway 198 to allow communication of annular fluid pressure into the interior of actuator 160 below seals 190, 192, thus establishing a pressure differential there across. The fluid passageway may include a choke or other flow control device to meter the rate at which annular fluid may enter the interior of actuator 160. Piston 186 includes a lower connector 200 designed to threadably couple to shaft 202. Shaft 202 has a lower threaded end 204.

In operation, upward force is placed on mandrel 176 by downhole power unit 100 via shaft 130 moving radially expanded section 180 into contact with shoulder 170 which breaks shear pins 196 and releases piston 186 from its initial fixed relationship with outer housing 162. Once piston 186 is free to move relative to outer housing 162, differential pressure acting across seals 190 cause piston 186 to move upwardly relative to outer housing 162 and mandrel 176. Upward movement of piston 186 upwardly shifts shaft 202.

As such, use of the downhole power unit 100 in combination with actuator 160 provides for higher velocity in the longitudinal movement transferred to the downhole perforator than through use of the downhole power unit 100 alone. Accordingly, when it is desirable to create high velocity longitudinal movement to accomplish a tubular penetration, actuator 160 may be included with the downhole perforator assembly of the present disclosure.

Even though a particular embodiment of an actuator has been depicted and described, it should be clearly understood by those skilled in the art that other types of actuators could alternatively be used in the downhole perforator assembly of the present disclosure.

Referring now to FIG. 5, therein is depicted a first embodiment of a downhole perforator generally designated 220. Downhole perforator 220 includes an outer housing 222. At its upper end, outer housing 222 has a radially reduced exterior portion 224 and an exterior shoulder 226 that allow for coupling with outer sleeve member 150 of downhole power unit 100, or with housing 162 of actuator 160, or other tool, depending upon the particular implementation. The coupling may be achieved using a threaded connection, a pin connection or other suitable means. Outer housing 222 includes a penetrator opening 228. Disposed opposite penetrator opening 228 on the exterior of outer housing 222 is a slip or anchoring member 230 that prevents movement of downhole perforator 220 relative to the tubular string during the perforation operation. Outer housing 222 has a lower connector 232 that allows downhole perforator 220 to be threadably coupled to other downhole tools or may receive a threaded plug therein.

Slidably and sealingly disposed within outer housing 222 is a mandrel 234. Mandrel 234 includes an upper connector 236 designed to threadably couple to shaft 130 of downhole power unit 100, shaft 202 of actuator 160, or other tool. Mandrel 234 has a radially expanded section 236 including a seal groove having a seal 238 located therein, which provides the sealing relationship with the interior outer housing 222. Mandrel 234 has a slotted ramp member 240 having an increasing slope section 242, a flat section 244 and a decreasing slope section 246. Mandrel 234 is initially fixed relative to outer housing 222 via shear pins 248.

Downhole perforator 220 also includes a penetrator 250 disposed between mandrel 234 and outer housing 222. Penetrator 250 has a base section 252 received within slotted ramp member 240 of mandrel 234 and slides along slotted ramp member 240 when mandrel 234 is shifted longitudinally upwardly relative to outer housing 222. Penetrator 250 also has a punch member 254 received within penetrator opening 228 of outer housing 222.

In operation, an upward force is placed on mandrel 234 directly by downhole power unit 100 via shaft 130 or by actuator 160 via piston 186 which breaks shear pins 248 releasing mandrel 234 from its initial fixed relationship with outer housing 222. As mandrel 234 is shifted longitudinally upwardly relative to outer housing 222, punch member 254 is radially outwardly extended from outer housing 222 as base section 252 slides along increasing slope section 242 of mandrel 234. Once flat section 244 is behind base section 252, punch member 254 is in its fully radially extended position. Continued upward shifting of mandrel 234 relative to outer housing 222 will then retract punch member 254 back into outer housing 222 as base section 252 slides down decreasing slope section 246. In this manner, downhole perforator 220 is able to create an opening through the sidewall of the tubular in which downhole perforator 220 is located.

Figure 6:
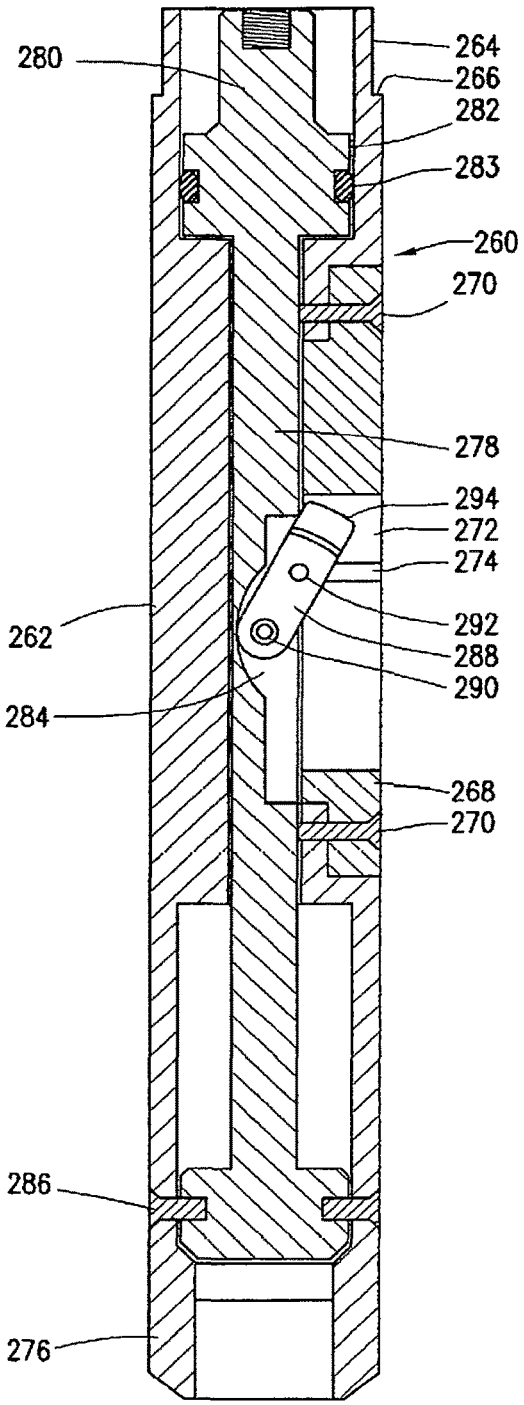
FIG. 6 (PRIOR ART)
FIG. 6 is a cross sectional view of a second embodiment of a downhole perforator of a downhole perforator assembly according to the present disclosure.

Referring now to FIG. 6, therein is depicted a second embodiment of a downhole perforator generally designated 260. Downhole perforator 260 includes an outer housing 262. At its upper end, outer housing 262 has a radially reduced exterior portion 264 and an exterior shoulder 266 that allow for coupling with outer sleeve member 150 of downhole power unit 100, with outer housing 162 of actuator 160, or to another tool, depending upon the particular implementation. The coupling may be achieved using a threaded connection, a pin connection or other suitable means. Outer housing 262 includes a penetrator guide member 268 attached to outer housing 262 via screws 270. Penetrator guide member 268 includes a longitudinal slot 272 and a radial slot 274. Outer housing 262 has a lower connector 276 that allows downhole perforator 260 to be threadably coupled to other downhole tools or may receive a threaded plug therein.

Slidably and sealingly disposed within outer housing 262 is a mandrel 278. Mandrel 278 includes an upper connector 280 designed to threadably couple to shaft 130 of downhole power unit 100, shaft 202 of actuator 160, or to another tool. Mandrel 278 has a radially expanded section 282 including a seal groove having a seal 283 located therein, which provides the sealing relationship with the interior outer housing 262. Mandrel 278 has a longitudinal slot 284. Mandrel 278 is initially fixed relative to outer housing 262 via shear pins 286.

Downhole perforator 260 also includes a penetrator 288 disposed within longitudinal slot 284 of mandrel 278 and longitudinal slot 272 of other housing 262. Penetrator 288 is rotatably mounted to mandrel 278 via a pin 290. Penetrator 288 also has an alignment pin 292 positioned within radial slot 274 of outer housing 262.

In operation, an upward force is placed on mandrel 278 directly by downhole power unit 100 via shaft 130 or by actuator 160 via piston 186 which breaks shear pins 286 releasing mandrel 276 from its initial fixed relationship with outer housing 262. As mandrel 278 is shifted longitudinally upwardly relative to outer housing 262, penetrator 288 rotates within longitudinal slot 284 of mandrel 278 and longitudinal slot 272 of other housing 262 about pin 290 and alignment pin 292 moves radially outwardly in radial slot 274 of outer housing 262. As penetrator 288 rotates, a cutting surface 294 of penetrator 288 extends radially outwardly from outer housing 262. Continued upward shifting of mandrel 278 relative to outer housing 262 continues to rotate penetrator 288 until it is retracted into outer housing 262. In this manner, downhole perforator 260 is able to create a longitudinal cut through the sidewall of the tubular.

Figure 7:
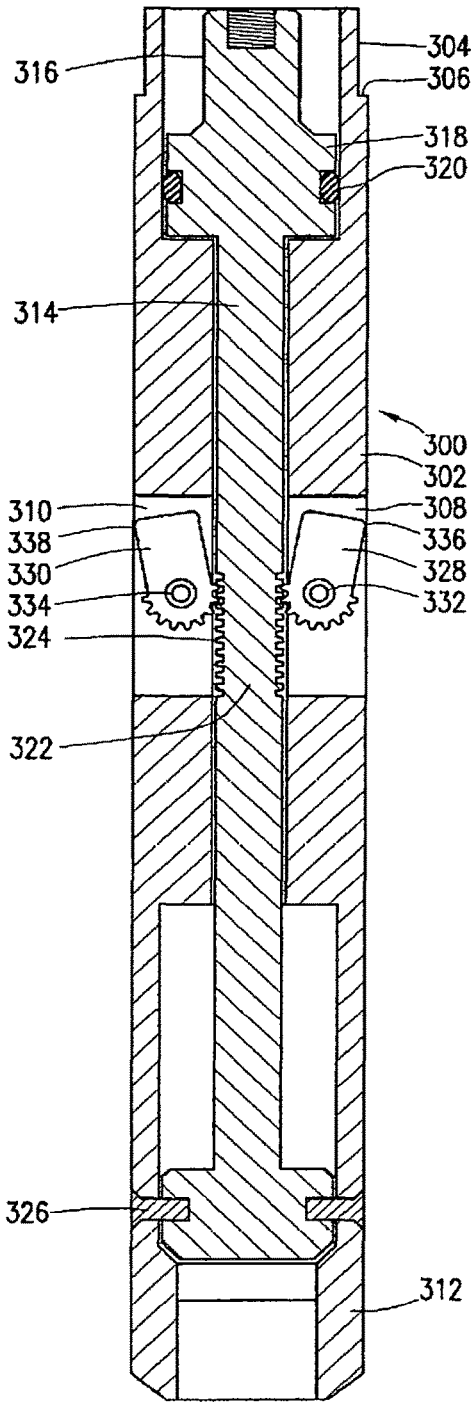
FIG. 7 is a cross sectional view of a third embodiment of a downhole perforator of a downhole perforator assembly according to the present disclosure.

Referring now to FIG. 7, therein is depicted a third embodiment of a downhole perforator generally designated 300. Downhole perforator 300 includes an outer housing 302. At its upper end, outer housing 302 has a radially reduced exterior portion 304 and an exterior shoulder 306 that allows for coupling with outer sleeve member 150 of downhole power unit 100, outer housing 162 of actuator 160, or other tool. The coupling may be a threaded connection, a pin connection or other suitable means. Outer housing 302 includes a pair of longitudinal slots 308, 310. Outer housing 302 has a lower connector 312 that allows downhole perforator 300 to be coupled to other downhole tools or may receive a threaded plug therein.

Slidably and sealingly disposed within outer housing 302 is a mandrel 314. Mandrel 314 includes an upper connector 316 designed to threadably couple to shaft 130 of downhole power unit 100, shaft 202 of actuator 160, or other tool. Mandrel 314 has a radially expanded section 318 including a seal groove having a seal 320 located therein, which provides the sealing relationship with the interior of outer housing 302. Mandrel 314 has a rack section 322 that has a plurality of teeth 324. Mandrel 314 is initially fixed relative to outer housing 302 via shear pins 326.

Downhole perforator 260 also includes a pair of oppositely disposed penetrators 328, 330 that are respectively positioned within longitudinal slots 308, 310 of other housing 302. Penetrators 328, 330 are rotatably mounted to outer housing 302 via respective pins 332, 334. Each penetrator 328, 330 has a plurality of teeth which mesh with teeth 324 of mandrel 314.

In operation, an upward force is placed on mandrel 314 directly by downhole power unit 100 via shaft 130 or by actuator 160 via piston 186 which breaks shear pins 326 releasing mandrel 314 from its initial fixed relationship with outer housing 302. As mandrel 314 is shifted longitudinally upwardly relative to outer housing 302, the teeth of penetrators 328, 330 mesh with teeth 324 of mandrel 314 such that penetrators 328, 330 rotate within longitudinal slots 308, 310 of other housing 302 about pins 332, 334. As penetrators 328, 330 rotate, cutting surfaces 336, 338 of penetrators 328, 330 extend radially outwardly from outer housing 302. Continued upward shifting of mandrel 314 relative to outer housing 302 continues to rotate penetrators 328, 330 until they are retracted into outer housing 302. In this manner, downhole perforator 300 is able to create a pair of longitudinal cuts through the sidewall of the tubular in which downhole perforator 300 is located.

Figure 8:
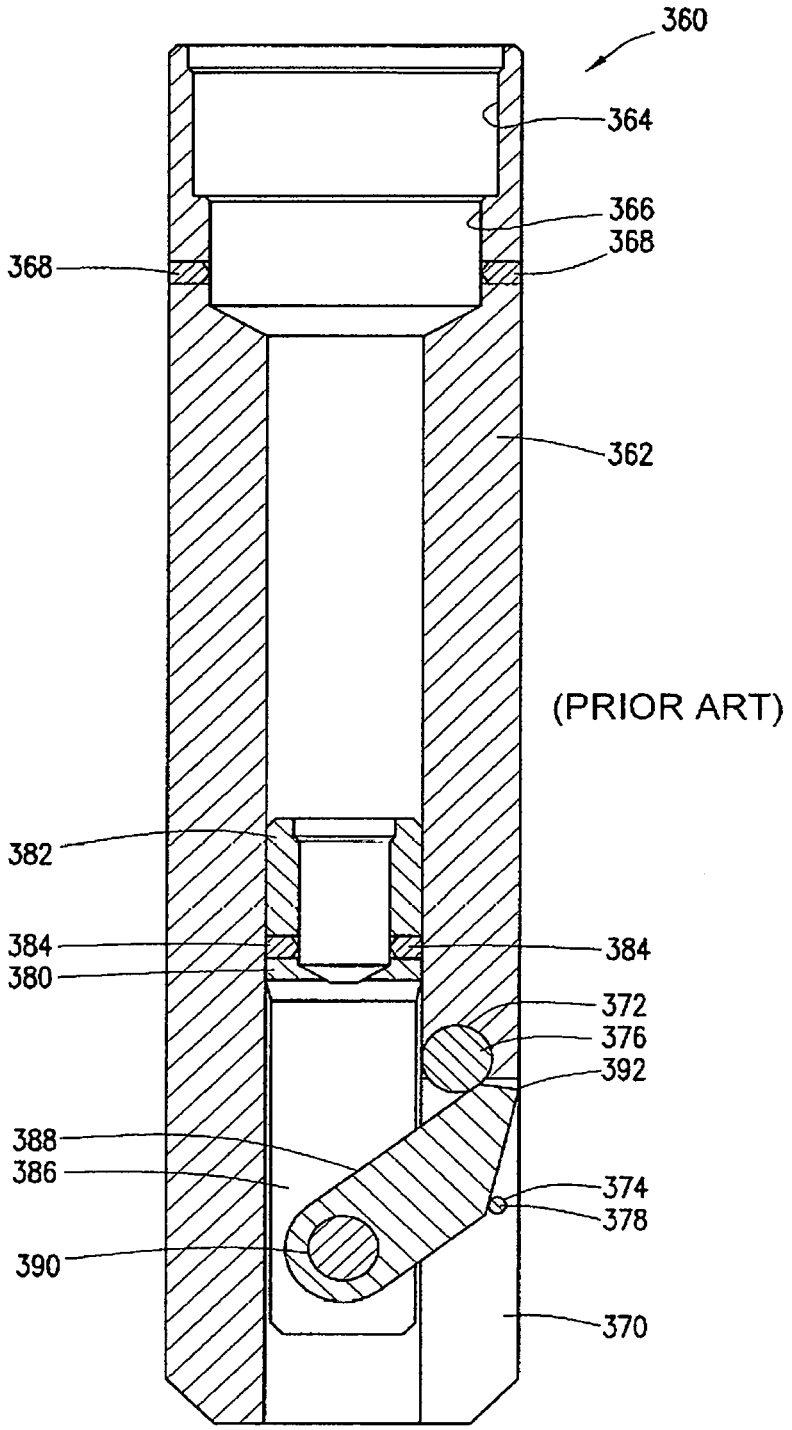
FIG. 8 is a cross sectional view of a fourth embodiment of a downhole perforator of a downhole perforator assembly according to the present disclosure.

Referring now to FIG. 8, therein is depicted a fourth embodiment of a downhole perforator generally designated 360. Downhole perforator 360 includes an outer housing 362. At its upper end, outer housing 362 has an interior profile 364 including a radially reduced section 366 that allows for coupling with outer sleeve member 150 of downhole power unit 100 via a direct connection with a suitably designed outer sleeve member or via a suitably designed adaptor. Likewise, interior profile 364 allows for coupling with outer housing 162 of actuator 160 via a direct connection with a suitably designed outer housing or via a suitably designed adaptor. In the illustrated embodiment, such coupling is achieved by sliding the mating portion of the downhole power unit 100, actuator 160, or suitable adaptor, into profile 364 the tightening set screws 368 to prevent decoupling. Outer housing 362 includes a longitudinal slot 370, a support pin receiving slot 372 and a lock pin receiving slot 374. A support pin 376 is disposed within support pin receiving slot 372 and a lock pin 378 is disposed within lock pin receiving slot 374.

Slidably disposed within outer housing 362 is a mandrel 380. Mandrel 380 includes an upper connector 382 to receive shaft 130 of downhole power unit 100, shaft 202 of actuator 160, or other appropriate tool therein. In the illustrated embodiment, set screws 384 are used to secure the received shaft within upper connector 382. Mandrel 380 has a longitudinal slot 386.

Downhole perforator 360 also includes a penetrator 388 disposed within longitudinal slot 386 of mandrel 380 and longitudinal slot 370 of other housing 362. Penetrator 388 is rotatably mounted to mandrel 380 via a pin 390. Longitudinal movement of mandrel 380 relative to housing 362 is initially prevented by lock pin 378 which initially prevents rotation of penetrator 388.

In operation, an upward force is placed on mandrel 380 directly by downhole power unit 100 via shaft 130, or by actuator 160 via piston 186, which breaks lock pin 378 releasing mandrel 380 from its initial fixed relationship with outer housing 362. As mandrel 380 is shifted longitudinally upwardly relative to outer housing 362, penetrator 388 rotates within longitudinal slot 386 of mandrel 380 and longitudinal slot 370 of other housing 362 about pin 390 and with the aid of pin 376. As penetrator 388 rotates, a cutting surface 392 of penetrator 388 extends radially outwardly from outer housing 362. Continued upward shifting of mandrel 380 relative to outer housing 362 continues to rotate penetrator 388 until it is retracted into outer housing 362. In this manner, downhole perforator 360 creates a longitudinal cut through the sidewall of the tubular.

Figure 9:
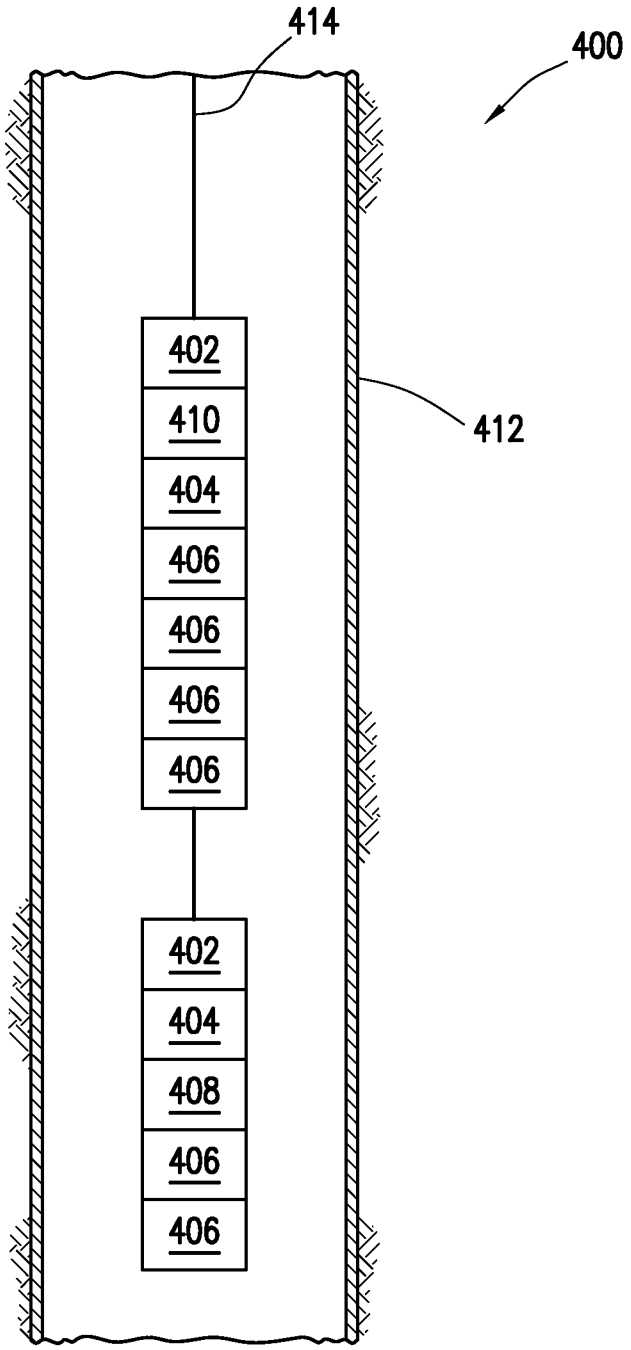
FIG. 9 is a block diagram representation of an exemplary tool string for providing multiple mechanical perforations downhole according to an aspect of the disclosure.

FIG. 9 is a schematic view of an exemplary tool string 400 according to an aspect of the disclosure. The tool string 400, positioned in wellbore 412 on conveyance 414, has one or more downhole power units 402, linear actuators 404, downhole mechanical perforating tools 406, force multipliers 408, and stroke amplifiers 410. While it is not anticipated that a work string will use all of these tools, it is anticipated that some embodiments of the methods and apparatus disclosed herein will employ multiple such tools arranged in various possible orders.

Downhole power units, commercially available, have defined design limitations as to supplied force, power, torque, etc. Further, such units have a defined stroke length, which can be used partially, incrementally, or entirely during one or more downhole operations. Some of the embodiments herein require greater amounts of force, power, torque, etc., than others. For example, embodiments having multiple penetrators or punch members operating simultaneously to perforate the tubing will require a greater force than those wherein the multiple penetrators are operated sequentially. Conversely, for sequentially operated penetrators, a longer stroke length may be desirable than for simultaneously operated penetrators. Consequently, one or more force multipliers 408, stroke amplifiers 410, or both can be employed in a work string to meet the requirements of the particular embodiment.

Commercial downhole power units are made in various sizes with various specifications depending on intended use. Downhole power units are available which operate based on a carried electrical power supply, such as battery, or a surface electrical power source via cable. Other units are available which operate off of tubing or hydraulic pressure. Downhole power units are available which operate unidirectionally or bi-directionally. For example, a downhole power unit such as described herein above is available to operate bi-directionally, providing powered movement in the upwards direction and in the downwards direction. Further, some units, particularly electric powered units, are available which can be operated multiple times in a single direction, moving a shaft or rod a defined or selected distance each time. Units are available to operate a single time per trip or multiple times per trip. Each of these available options can be utilized in various embodiments of the disclosure.

Further, downhole power units are available having short strokes, of only a few inches, up to relatively long strokes, such as about 36 inches, etc. While a short stroke may suffice for operating a single mechanical perforator, a system with a single punch member or simultaneously operated punches, a longer stroke may be required to operate a plurality of mechanical perforator tools, or a system with multiple punches or sequentially operated punches. Persons of skill in the art will recognize that use of one or more force multipliers, known in the art, or stroke amplifiers, also known in the art, can be used for selective configuration of mechanical perforator tools or punch members. The force multipliers and stroke amplifiers can be positioned in various relation to the other tools on the string, as needed.

Where it is desired to operate a plurality of mechanical perforator tools or to operate a tool multiple times per trip, especially at multiple locations downhole, additional downhole power units can be positioned in the string and operatively associated with one or more perforator tools.

Figure 10:
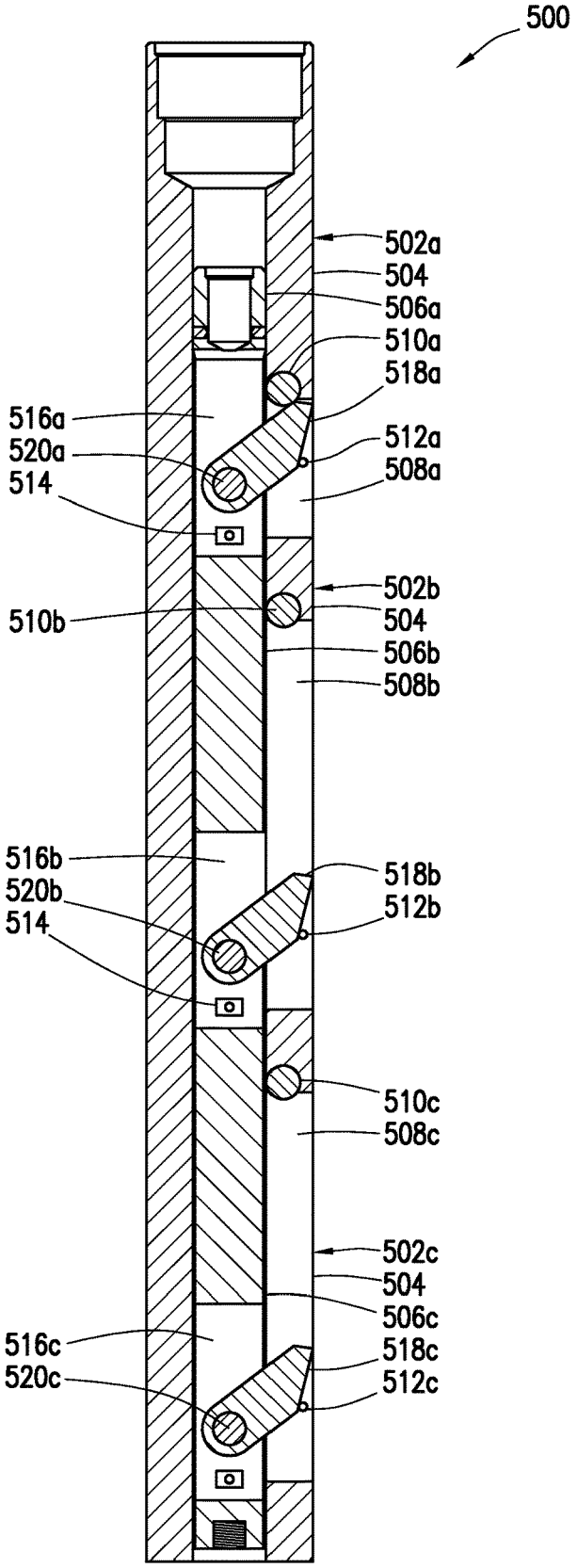
FIG. 10 is an elevational, cross-sectional schematic view of an exemplary configuration of a series of mechanical perforator tools according to an aspect of the disclosure.

FIG. 10 is an elevational, cross-sectional schematic view of an exemplary configuration of a series of mechanical perforator tools, generally designated 500, according to an aspect of the disclosure. The downhole perforator tools 502*a-c* depicted in FIG. 10 are similar to that of FIG. 8 and will consequently not be described in as much detail.

Each downhole perforator 502*a-c* includes an outer housing 504*a-c*. At the upper and lower ends of the tools, profiles or other connections are defined to allow coupling of the outer housings to tools positioned above or below. Similarly, mandrels 506*a-c* each define upper and lower profiles, threads, pins, etc., for coupling to additional mandrels positioned above and below. It is understood that the couplings and connections can use threads, pins, etc., as known in the art, and can provide for connection with similar perforator tools, actuator tools, downhole power units, plugs, etc.

Each outer housing 504*a-c* includes a longitudinal slot 508*a-c*. A support pin 510*a-c* and a lock-pin 512*a-c* are mounted on the housing. Slidably disposed within each housing is a mandrel 506*a-c*. Each mandrel includes connection mechanisms for coupling to other mandrels or tool elements above and below. The connections for each mandrel need not be similar. For example, the upper mandrel 506*a*, at its upper end, has a shaft receptor, such as seen in FIG. 8, while the upper ends of mandrels 506*b-c* each have a cooperating part of a pin connection assembly 514.

Each mandrel 506*a-c* defines a longitudinal slot 516*a-c*. In each tool, a penetrator 518*a-c* is disposed in longitudinal slot 516 of the mandrel 514 and longitudinal slot 508 of the outer housing 504. The penetrator is rotatably mounted to the mandrel via a pin 520. Longitudinal movement of mandrel relative to the housing is initially prevented by the lock or shear pins 512*a-c*, which block rotation of the penetrators.

The multiple penetrators are shown with one penetrator positioned on each of a series of perforator tools. Alternately, multiple penetrators can be positioned in a single tool, on a single or multiple mandrels, etc., as those of skill in the art will recognize. Note also that the penetrators 518 are aligned at a common orientation such that the perforations define a line in the tubing. Other arrangements will be apparent to those of skill in the art. The penetrators can be arranged to extend radially at different radial orientations, on opposite sides of the tool, etc.

In operation, an upward force is placed on the upper mandrel 506*a*. The force is transferred to the lower mandrels 506*b-c*. The upward force can be applied directly by a downhole power unit via a shaft connected to the upper mandrel 506*a*. Alternately, the upward force can be applied through one or more force multipliers, stroke amplifiers, or actuators. Force multipliers can be used, for example, where the multiple penetrators are simultaneously radially extended to puncture the tubing. Stroke amplifiers can be used, for example, where, as seen in FIG. 10, a plurality of penetrators are radially extended to puncture the tubing sequentially.

The system presented in FIG. 10 is for sequential operation of a plurality, here three, penetrators arranged in series. The mandrels are moved upwards a first stroke distance. Shear pin 512*a* is sheared, releasing the mandrel to move upwardly and the penetrator 518*a* to rotate in longitudinal slot 516*a* of the mandrel and slot 508*a* of the housing, and about pin 520*a*, in response to the mandrel movement. As the penetrator 512*a* rotates, it extends radially into cutting contact with the tubing, thereby perforating the tubing. Continued upward movement of the mandrel 506*a* rotates the penetrator 518*a* until it is retracted into the housing.

Similarly, continued upward movement of the mandrels 506*a-c*, results in sequential operation of the tools 502*b-c*. As the mandrels move upwardly, the penetrator 518*b* on mandrel 506*b* is moved into contact with support pin 510*b* and into alignment with longitudinal slots 508*b* and 516*b*. As with the perforation operation described above, a shear pin 512*b* is sheared, penetrator 518*b* is rotated about pin 520*b* and radially extended, cutting into the tubing. Continued movement upwards rotates the penetrator radially inward until it is retracted in the housing. Finally, further upwards movement of the mandrels results in operation of penetrator 518*c* as it aligns with longitudinal slots 508*c* and 516*c*, is rotated to cut the tubing and then rotated to a retracted position.

The system can be modified to perform simultaneous perforations with the plurality of penetrators by simply having each tool operate during the same stroke distance of the mandrels.

Alternately, where the system of FIG. 10 is operated using an electric powered unit with a surface power supply, for example, the mandrels can be stroked incrementally. That is, the mandrels can be stroked a first distance to operate the upper penetrator 518*a*, then stopped or powered off while the string is moved to a second location. At the second location, the power unit is again operated to stroke the mandrels (in the same direction) a second distance, thereby operating the penetrator 518*b*. The process can be repeated as desired according to the number of penetrators or perforating tools on the string.

Alternately, a bi-directional downhole power unit can be employed with a work string having one or more perforating tools. In such a case, multiple mandrels can be stroked in a first direction, incrementally or in a single stroke, to create perforations, simultaneously or sequentially. The string is then re-located to a second position, and stroked in the reverse direction to create a second set of perforations. Where a single perforator tool and penetrator are employed, the unit can pull or push the mandrel to create a perforation at a first location, and then, after moving the string to a second location, the unit can pull or push the mandrel to create a second perforation.

References herein to movement of the work string or perforator tools to second or multiple locations is specifically intended to include movement rotationally or longitudinally in the well. For example, preparatory to tubing cutting operations, it may be desirable to create multiple perforations in the tubing in a radial or spiral pattern.

The arrangement of the perforator assemblies can vary. Penetrators or tools can be oriented diametrically opposed, radially opposed and axially staggered, or any other desired arrangement. Further, the assemblies can be arranged in various angular orientations. For example, sets of perforator tools or penetrators can be oriented spaced apart at 120 degrees, 180 degrees, etc. Restrictions in tubing size, perforation depth, etc., may require the penetrators be arranged in the same orientation. An indexing feature can be used to create perforations at other angular orientations. For instance, the tool, the penetrators within the tool, or the tubing string itself can be rotated to perforate the surrounding tubular at other orientation.

The system can be run on wireline or similar and hydraulically actuated. In such a case, the perforator tool is preferably attached to a locating tool, such as the commercially available Otis X or R (trade name) type locking mandrel. The lock is set in a landing nipple at a desired location using well-known methods. The running tool used to set the locating device is retrieved. Hydraulic pressure is applied to the tubular to perform the perforating operation. The lock and perforator tool can be retrieved or the lock can be re-set with related equipment at additional landing nipples and the process repeated. It is also possible to attach a spacer extension tube between the lock and perforator and use the same landing nipple repeatedly.

The following disclosure is provided in support of the methods claimed or which may be later claimed. Specifically, this support is provided to meet the technical, procedural, and substantive requirements of certain examining offices. It is expressly understood that the portions or actions of the methods can be performed in any order, unless specified or otherwise necessary, that each portion of the method can be repeated, performed in orders other than those presented, that additional actions can be performed between the enumerated actions, and that, unless stated otherwise, actions can be omitted or moved. Those of skill in the art will recognize the various possible combinations and permutations of actions performable in the methods disclosed herein without an explicit listing of every possible such combination or permutation. It is explicitly disclosed and understood that the actions disclosed, both herein below and throughout, can be performed in any order (xyz, xzy, yxz, yzx, etc.) without the wasteful and tedious inclusion of writing out every such order verbatim. Methods of mechanically perforating a downhole tubular positioned in a subterranean wellbore, are disclosed, wherein exemplary methods comprise: Methods of mechanically perforating a downhole tubular positioned in a subterranean wellbore are disclosed, the methods comprising one or more of the following: a) running a mechanical perforator assembly into the downhole tubular in the wellbore at a selected location, an annulus defined between the perforator assembly and the downhole tubular; b) radially extending a plurality of mechanical penetrators movably mounted in the perforator assembly into contact with the downhole tubular; c) creating a plurality of perforations through the downhole tubular using the plurality of penetrators; and/or d) retracting the plurality of penetrators. The various methods can also include one or more of the following, in any order: gripping the downhole tubular to maintain the perforator assembly in the selected location; wherein gripping further comprises: landing on a landing nipple, or setting one or more gripping assemblies; wherein radially extending the plurality of penetrators further comprises: extending the plurality of penetrators linearly or rotationally; wherein radially extending the plurality of penetrators and creating the plurality of perforations further comprises: applying a mechanical, electro-mechanical, or hydraulic force to the penetrators; wherein radially extending the plurality of penetrators further comprises applying, in a passageway defined within a housing of the perforator assembly, a hydraulic force to the penetrators; increasing tubing pressure in a tubing string positioned in the wellbore, the passageway defined in the housing of the penetrator assembly in fluid communication with an interior passageway of the tubing string; wherein retracting the plurality of penetrators further comprises: biasing the plurality of penetrators toward a retracted position, decreasing tubing pressure within increasing a tubing string positioned in the wellbore, increasing wellbore pressure exterior to the penetrator assembly, or any combination thereof; wherein the penetrator assembly further comprises multiple penetrator tools connected one to another; wherein running in a penetrator assembly further comprises: lowering the penetrator assembly into the wellbore by wire line, slick line, coiled tubing, tubing string, or flowing the assembly downhole; further comprising, after retracting the plurality of penetrators: moving the penetrator assembly to a different location in the wellbore, radially extending the plurality of penetrators, creating a plurality of perforations through the downhole tubular, and retracting the plurality of penetrators; wherein the plurality of penetrators are aligned in radial orientation; wherein radially extending the plurality of penetrators and creating the plurality of perforations further comprises: applying a force and multiplying the force to move the penetrators; further comprising stroking a rod a stroke distance and amplifying the stroke distance to move the penetrators; wherein the plurality of penetrators are radially extended simultaneously or sequentially; and/or wherein an actuating force to move the plurality of penetrators is applied in an uphole direction, a downhole direction, or bi-directionally.

While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

It is claimed:

1. A method of mechanically perforating a downhole tubular positioned in a subterranean wellbore, the method comprising:

running a mechanical perforator assembly into the downhole tubular, the mechanical perforator assembly comprising perforator tools, each comprising a mechanical penetrator; and moving the perforator tools and mechanical penetrators together in a first axial direction to sequentially radially extend the mechanical penetrators to perforate the downhole tubular.

2. The method of claim 1, further comprising: gripping the downhole tubular to maintain the perforator assembly in a location.

3. The method of claim 2, wherein gripping further comprises: landing on a landing nipple, or setting one or more gripping assemblies.

4. The method of claim 1, wherein extending the mechanical penetrators further comprises: extending the mechanical penetrators linearly or rotationally.

5. The method of claim 1, wherein extending the mechanical penetrators further comprises: applying a mechanical, electro-mechanical, or hydraulic force to the penetrators.

6. The method of claim 1, wherein extending the mechanical penetrators further comprises applying, in a passageway defined within a housing of the perforator assembly, a hydraulic force to the penetrators.

7. The method of claim 6, further comprising: increasing tubing pressure in a tubing string positioned in the wellbore, the passageway defined in the housing of the penetrator assembly in fluid communication with an interior passageway of the tubing string.

8. The method of claim 1, comprising retracting the mechanical penetrators.

9. The method of claim 8, wherein retracting the plurality of penetrators further comprises: biasing the mechanical penetrators toward a retracted position, decreasing tubing pressure within a tubing string positioned in the wellbore, increasing wellbore pressure exterior to the penetrator assembly, or any combination thereof.

10. The method of claim 8, further comprising, after retracting the plurality of penetrators: moving the penetrator assembly to a different location in the wellbore, radially extending the mechanical penetrators, creating a plurality of perforations through the downhole tubular, and retracting the mechanical penetrators.

11. The method of claim 1, wherein running in the penetrator assembly further comprises: lowering the penetrator assembly into the wellbore by wire line, slick line, coiled tubing, tubing string, or flowing the assembly downhole.

12. The method of claim 1, wherein the mechanical penetrators are aligned in radial orientation.

13. The method of claim 1, wherein radially extending the mechanical penetrators further comprises: applying a force and multiplying the force to extend the mechanical penetrators.

14. The method of claim 1, further comprising stroking a rod a stroke distance and amplifying the stroke distance to extend the mechanical penetrators.

15. The method of claim 1, wherein an actuating force to extend the mechanical penetrators is applied in an uphole direction, a downhole direction, or bi-directionally.

16. A downhole tool assembly for perforating a downhole tubular in a wellbore extending through a subterranean formation, downhole tool assembly comprising:

a perforator assembly comprising perforator tools, each perforator tool comprising mechanical penetrators rotatably mounted on the perforator tools, wherein the perforator tools and mechanical penetrators are movable together in a first axial direction to sequentially perforate the downhole tubular by rotation of the mechanical penetrators into contact with the tubular at different times.

17. The downhole tool assembly of claim 16, wherein the mechanical penetrators are further rotatable to retract into the corresponding perforator tool.

18. The downhole tool assembly of claim 16, further comprising an actuator connected to the perforator tools, the actuator is: mechanical, electric, electro-mechanical, hydraulic, or a combination thereof.

19. The downhole tool assembly of claim 16, further comprising a force multiplier tool or a stroke amplifier tool.

* * * * *